US006269787B1

(12) United States Patent
McArthy

(10) Patent No.: US 6,269,787 B1
(45) Date of Patent: Aug. 7, 2001

(54) ROCKER COVER GASKET ASSEMBLY WITH INTEGRAL VALVE STEM SEALS

(75) Inventor: Troy D. McArthy, Kendallville, IN (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/482,201

(22) Filed: Jan. 12, 2000

Related U.S. Application Data

(63) Continuation-in-part of application No. 09/470,005, filed on Dec. 22, 1999.
(60) Provisional application No. 60/174,126, filed on Dec. 31, 1999.

(51) Int. Cl.[7] ..... F01L 3/08
(52) U.S. Cl. ..... 123/188.6; 277/502
(58) Field of Search ..... 123/188.6; 277/313, 277/591, 594, 502, 600

(56) References Cited

U.S. PATENT DOCUMENTS 3,869,859 * 3/1975 Thornburgh ..... 60/305
4,402,518 * 9/1983 Locacius ..... 277/166
4,593,659 * 6/1986 Wells et al. ..... 123/90.38
4,947,811 * 8/1990 Binford ..... 123/188.6
5,003,958 4/1991 Yoneyama et al. ..... 123/635
5,174,256 * 12/1992 Binford ..... 123/188.6
5,228,420 * 7/1993 Furuya et al. ..... 123/90.38
5,375,569 * 12/1994 Santella ..... 123/90.38
5,775,284 * 7/1998 Kirchner et al. ..... 123/188.6
6,123,054 * 9/2000 Netzer ..... 123/188.6

* cited by examiner

*Primary Examiner*—Noah P. Kamen
*Assistant Examiner*—Hai Huynh
(74) *Attorney, Agent, or Firm*—Rader, Fishman & Grauer PLLC

(57) ABSTRACT

A rocker cover gasket assembly is provided that is suitable for use in connection with a valve assembly for an internal combustion engine. The rocker cover gasket assembly includes a carrier, a plurality of valve stem seals integral with the carrier and at least one connector, wherein the connector is connected to two adjacent valve stem seals to form a linkage or a web of valve steam seals. The connectors and carrier may contain one or more handle members to improve manual or mechanical handling of the assembly. The connectors and portions of the carrier may be formed with thinned portions to allow for selective removal of individual valve stem seals in the event of wear or failure.

20 Claims, 3 Drawing Sheets

ROCKER COVER GASKET ASSEMBLY WITH INTEGRAL VALVE STEM SEALS

RELATED APPLICATIONS

The present application is a Continuation-in-Part of U.S. application Ser. No. 09/470,005, filed Dec. 22, 1999, entitled "Multi-Seal Retainer Assembly and Method for Making Same" and Provisional U.S. patent application Ser. No. 60/174,126, filed Dec. 31, 1999 entitled "Rocker Cover Gasket Assembly With Integral Valve Stem Seals". Applicant incorporates the application herein by reference and claims priority of the earlier filed application pursuant to 35 U.S.C. §119(e) and 120.

FIELD OF THE INVENTION

The present invention generally relates to rocker cover gaskets and valve assemblies. More particularly, the present invention relates to a rocker cover gasket having integral valve stem seals for use in connection with a valve assembly for an internal combustion engine.

BACKGROUND OF THE INVENTION

A valve assembly for an internal combustion engine generally includes a valve spring and a valve seal having a retainer. Before the valve spring and the retainer fit into place, a valve seal is usually positioned over a valve stem. Valve stem seals control the amount of oil allowed between a valve stem and a valve stem guide. The seal functions in the manner of a positive seal or umbrella seal to prevent oil from flowing down the valve stem into the combustion chamber. The spring, which normally acts to keep the valve closed, is held in place by an individual retainer that is secured onto the valve stem. Such retainers typically prevent the valve spring from wearing into the engine head surface. A rocker cover gasket is separately provided to further insure against lubricant flowing into the combustion chamber. However, individual valve stem seal assemblies and rocker cover gaskets are undesirable due to increased assembly time and increased likelihood of manufacturing nonconformaties.

Another known type of valve seal assembly includes a rocker cover sealing member having coil seal members and bolt seal members connected together in series. The coil seal members are positioned on the outermost ends of the rocker cover sealing member and are arranged in a straight line in series on a single blank to correspond to ignition coil mounting holes. A narrow connection member secures the coil seal members together. However, this type of known rocker cover sealing member is undesirable as there is no means for compensating for self-alignment and tolerance problems. Further, there is no mechanism for selective removal of individual valve stem seals in the event of wear or failure of an individual valve stem seal.

Accordingly, there exists a need for an improved combination of a rocker cover gasket having integral valve stem seals. More particularly, there exists a need for a rocker cover gasket having multiple integral valve stem seals that is easy to produce, reduces the number of engine components, and makes the components that are used easier to handle and assemble with respect to a particular engine head configuration.

SUMMARY OF THE INVENTION

The present invention recognizes the limitations associated with currently available multi-seal assemblies and the production of such assemblies. The present invention provides an assembly that includes a rocker cover gasket having individual valve seals connected into a single assembly unit.

Rather than providing individual seals for each valve stem, a molded assembly can be used to seal all of the valve stems on a head of an engine. The assembly can be designed for a particular engine head with specific valve guide spacing having various angles. Further, such a rocker cover gasket/valve stem seal assembly will generally function to hold or retain the rubber portion of the individual seals and to act as a type of valve spring washer to prevent the valve spring from wearing into the head surface of an engine.

The present invention provides several advantages over conventional valve assemblies including, improved functionality, ease of manufacture, and convenient implementation and use. For instance, by forming a single rocker cover gasket assembly comprised of a plurality of integral valve stem seals, the number of component parts in an engine can be reduced, thereby streamlining the assembly process. Moreover, the rocker cover gasket assembly of the present invention may be tailored to specific engine head configurations to further improve the assembly process. Also, if desired, the rocker cover gasket assembly can be formed to include one or more handle portions, thereby making the assembly easier to handle and assemble in connection with a valve assembly.

In accordance with a preferred embodiment of the invention, a one-piece rocker cover gasket assembly is provided that is suitable for use in connection with a valve assembly for an internal combustion engine. The rocker cover assembly includes a molded structural plastic carrier with elastomeric gasket material molded around a peripheral edge of the carrier such for increased sealing effectiveness. A plurality of valve stem seals are integrally connected to the carrier by a plurality of carrier arms. By integrally connecting the carrier to the valve stem seals, a single gasket assembly is formed having the advantage of serving as a gasket that properly positions valve stem seals to permit ease of handling and reducing assembly time and inventory control costs.

In another preferred embodiment, rocker cover gasket assembly may be further provided with optional connectors, the connectors being used to connect or link one valve stem seal to another to form a type of linkage or web of valve stem seals. The connectors add a degree of rigidity to the assembly to insure proper placement of the valve stem seals in relation to the carrier. The connectors may be flat or curved to add a degree of flexibility to the gasket/seal assembly to compensate for tolerance and alignment difficulties.

Preferably, the ends of each connector and carrier arms that are adjacent to each valve stem seal are each provided with a thinned portion. The thinned portions are deformable to permit selective removal of individual valve stem seals from the carrier in the event of a failure or excessive wear of the valve stem seal. Optional pads or handles may also be incorporated on the connectors, or on the carrier to facilitate handling of the rocker cover gasket assembly or to serve as sprues during molding of the gasket.

BRIEF DESCRIPTIONS OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENT

Figure 1:
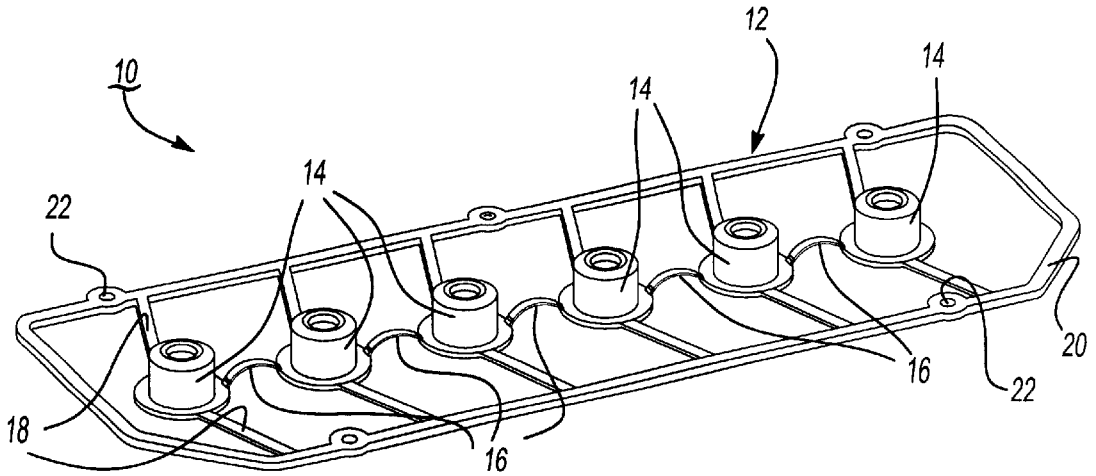
FIG. 1 is a perspective view of an embodiment of a rocker cover gasket assembly constructed in accordance with the principles of the present invention.
Figure 2:
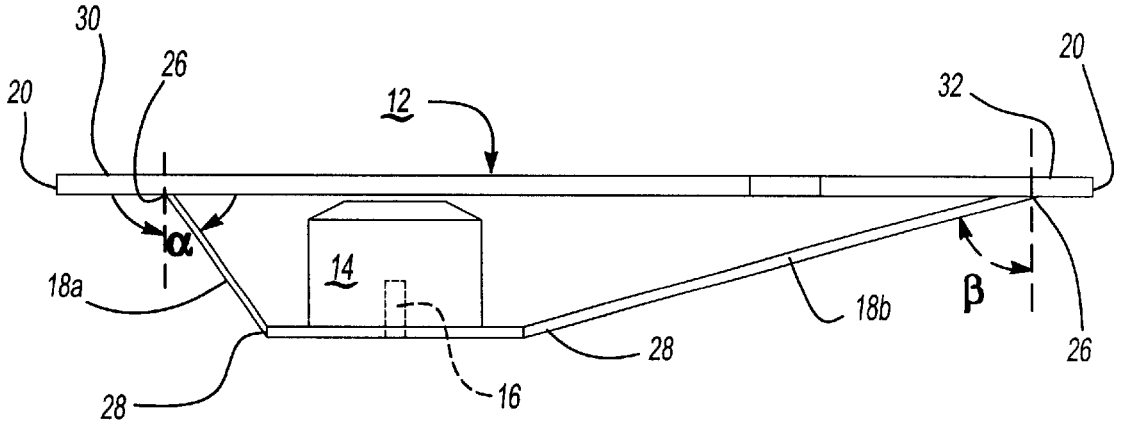
FIG. 2 is side elevation view of the rocker cover gasket assembly shown in FIG. 1.
Figure 3:
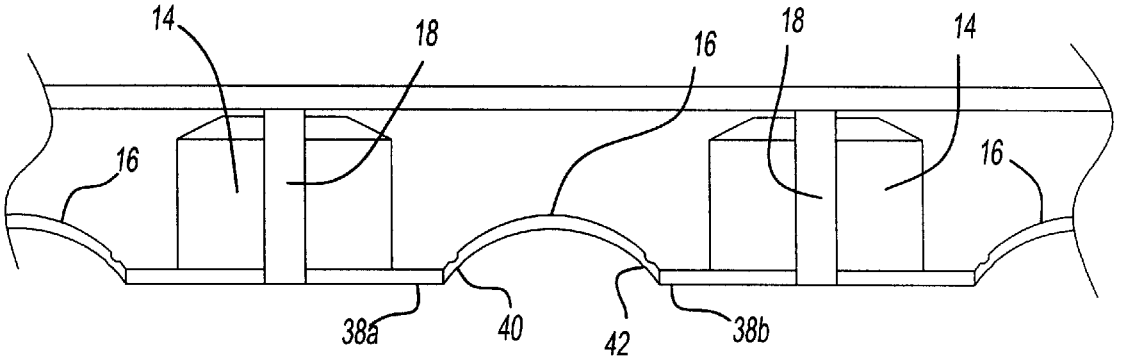
FIG. 3 is a front elevation view of the rocker cover gasket.
Figure 4:
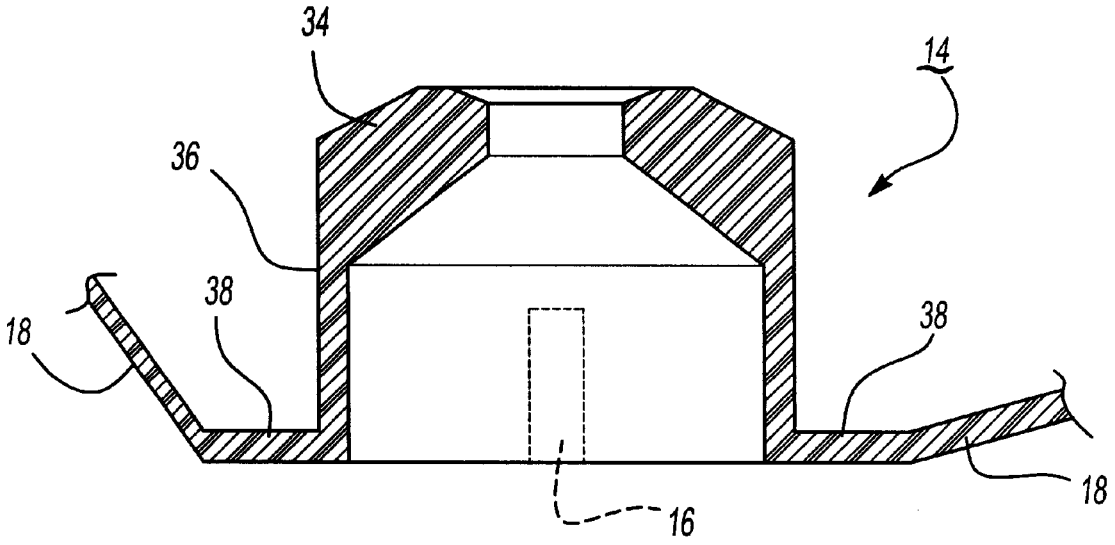
FIG. 4 is a cross sectional side elevation view of an embodiment of an individual seal.

Referring to FIGS. 1–3, a preferred embodiment of a rocker cover gasket assembly 10 is shown. In accordance with the present invention, rocker cover gasket assembly 10 includes a carrier 12, a plurality of valve stem seals 14 and multiple connectors 16. Preferably, the connectors 16 are used to connect or link one individual valve stem seal 14 to another to form a linkage or web of valve stem seals. Carrier 12 further includes carrier arms 18 that integrally connect valve stem seals 14 to carrier 12.

Figure 5:
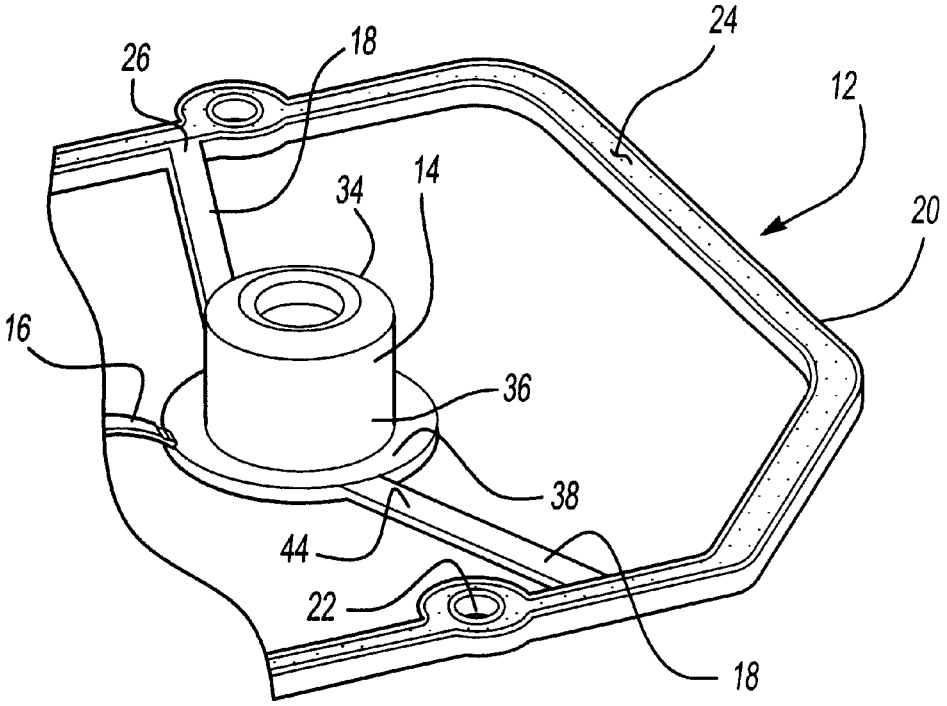
FIG. 5 is an enlarged perspective view of the rocker cover gasket assembly.

Carrier 12 is defined by an outer periphery 20 that is sized and shaped to mate with the internal components of a combustion engine (not shown). Periphery 20 has retaining apertures 22 formed therein for receiving fasteners, such as bolts and the like, to secure rocker cover gasket assembly 10 to the engine. In accordance with another aspect of the invention, it is preferred that periphery 20 of carrier 12 includes a sealing member 24, as shown in FIG. 5. In one preferred embodiment, sealing member 24 is a sealing bead that is disposed on periphery 20 and compresses when positioned between a rocker cover and the engine to serve as a gasket. In another preferred embodiment, sealing member 22 is an elastomeric material that is molded to periphery 20 of carrier 12. Other suitable sealing members may be employed as well.

Carrier 12 is connected to valve stem seals 14 via integral carrier arms 18. Carrier arms 18 serve to properly position valve stem seals 14 on carrier 12. Carrier 12 includes at least two carrier arms 18 with at least one carrier arm 18 connected to a single valve stem seal 14. In preferred embodiment, each valve stem seal 14 is connected to carrier 12 by at least one carrier arm 18. In an alternative embodiment, only two of valve stem seals 14 are connected to carrier 12 by carrier arms 18, the valve stem seals being connected together via connectors 16, to be explained in further detail below.

Each carrier arm 18 includes a carrier end 26 and a valve stem end 28. Carrier ends 26 are integrally connected to outer periphery 20 and valve stem ends 28 are connected to valve stem seals 14. To allow for proper positioning of the valve stem seals 14 in relation to engine components, different sized carrier arms 18 may be provided. For example, referring to FIGS. 1 and 2, valve stem seals 14 are positioned so as to be offset from a center of rocker cover gasket 10 with the valve stem seals being lower than periphery 20 of carrier 12. Accordingly, carrier 12 includes first carrier arms 18*a* and second carrier arms 18*b*. First carrier arms 18*a* extend inwardly and downwardly from a rear wall 30 of carrier 12 and at a first arm angle $\alpha$. Second carrier arms 18*b* extend inwardly and downwardly from a front wall 32 of carrier 12 at a second arm angle $\beta$.

In a preferred embodiment, the individual valve stem seals 14 have a form or shape that generally resembles a top hat comprised of an upper portion 34 and a lower portion 36. Lower portion 36 includes an annular washer 38 that extends outwardly in a radial direction from the upper portion 34. It is preferred that annular washer 38 be integral with lower portion 36 to reduce assembly and inventory control costs. However, it should be noted that the shape or form of the valve stem seals 14 is not critical to the practice of the present invention and, provided the valve stem seals 14 can provide the necessary function, each valve stem seal 14 may by formed in any conventional configuration.

As discussed above, rocker cover gasket assembly may further include connectors 16 for connecting adjacent valve stem seals 14 together. For example, referring to FIGS. 1 and 3, valve stem seals 14 are connected or joined in a linear chain or succession. However, the present invention is not limited to a specific configuration and provides a rocker cover gasket assembly 10 that can be tailored and prefabricated for use in connection with a number of different engine head designs. For instance, rocker cover gasket assembly 10 with a configuration of the type shown in FIG. 1 and 2 can be used in connection with a 6-cylinder engine having two valves per cylinder. Likewise, further embodiments of the present invention can be used in connection with various other engine head designs. By way of example, and without limitation, rocker cover gasket assembly 10 can be designed to include a valve stem seal 14 configuration for an entirely different 6-cylinder engine, i.e., one that has four valves per cylinder. The ability to tailor rocker cover gasket assembly 10 to a particular valve assembly provides a number of manufacturing and assembly-related benefits and advantages.

Connectors 16 are primarily used to connect or link two individual valve stem seals 14, although as further described herein, other functions are also contemplated. As shown in FIGS. 3 and 5, connector 14 has a first end 40 and a second end 42, wherein first end 40 is connected to annular washer 38*a* and second end 42 is connected to annular washer 38*b* of an adjacent valve stem seal 14. Connectors 14 may be flat, but preferably are curved. Curved connectors 14 are flexible and thus compensate for alignment and tolerance nonconformities. The use of connectors 16 is desirable because connectors 14 provide a degree of rigidity to maintain valve stem seal 14 in place in relation to carrier 12, while providing flexibility to insure proper positioning of valve stem seals 14 on the engine valve stems.

Figure 6:
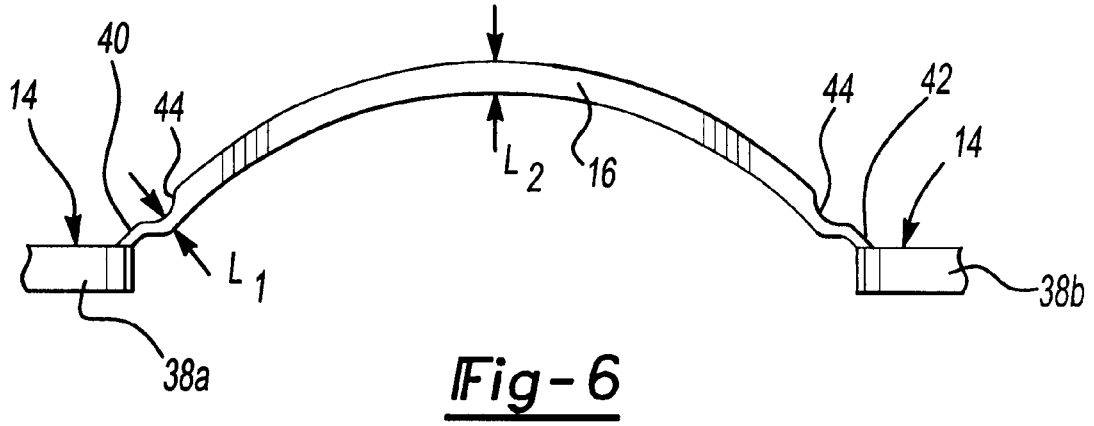
FIG. 6 is an enlarged front elevation view of the connector shown in FIG. 5.

As shown in FIGS. 5 and 6, in accordance with another aspect of the invention, connectors 16 and carrier arms 18 (shown in phantom in FIG. 5) may include at least one thinned portion 44 that is deformable to permit selective removal of individual valve stem seals 14. For example, each connector 16 has at least two such thinned portions 44 positioned at ends 40 and 42. The thinned portions 44 serve to allow the assembly to be more easily separated into sub-assemblies and/or for the replacement of an individual valve stem seals 14. The cross-sectional area of thinned portions 44 of connectors 16 are generally less than that of the other cross sections of connector 16. In a preferred embodiment, connector 16 includes a thinned portion 44 that has a generally semi-circular shape in which the length $L_1$ of the cross sectional area of thinned portion 44 taken through said semicircular formation is less than 75%, and more preferably less than one-half, of the length $L_2$ of the cross sectional area taken through the thickest portion of the connector 16. While thinned portions 44 may be positioned at any location upon the connector 16 and carrier arms 18, thinned portions 44 are preferably positioned in close proximity or substantially adjacent to the point at which connector 16 meets valve stem seal 14.

Figure 7:
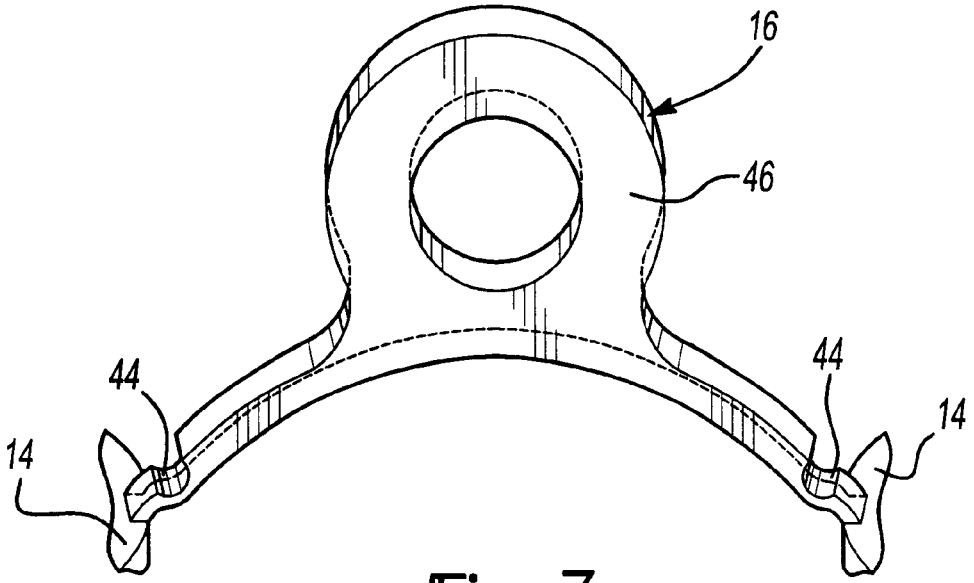
FIG. 7 is an enlarged perspective view of another embodiment of a connector that includes a handle portion.

In accordance with another feature of the present invention, the connectors 16 of rocker cover gasket assembly 10 may additionally include one or more handle member 46. An enlarged perspective view of another embodiment of a connector that includes a handle member 46 is provided in FIG. 7. Handle member 46 may be included with one or more of connectors 16 to provide for improved manual and/or mechanical handling of the rocker cover gasket assembly 10. In addition, handle member 46 may serve as a molding sprue during the manufacturing process of the gasket assembly 10 to facilitate material flow from one cavity to an adjacent cavity. While the handle member 46 is not limited to a particular design and may take on any form that does not interfere with the functioning of the component and provides a quick and convenient means for handling and storing rocker cover gasket assembly 10.

In a preferred embodiment, the valve stem seals 14, connectors 16 and carrier 12 are comprised of plastic. A number of types of conventional plastic materials can used to form rocker cover gasket assembly 10. However, any such plastic material must be capable of withstanding and properly operating in the intended environment. In the case of an internal combustion engine, rocker cover gasket assembly 10 must be capable of properly operating in elevated temperature and pressure ranges.

A preferred method for making a retaining assembly 10 in accordance with the present invention includes the steps of: (a) providing a multi-cavity mold for producing plastic parts, and (b) molding a plurality of valve stem seals 14 having at least one connector 16 connected to two adjacent valve stem seals 14 and a carrier 12 for holding the valve stem seals 14 in place. The multi-cavity mold can be of a conventional split-mold design or any other conventional type that is capable of forming the desired configuration of the gasket assembly 10 in a dimensionally-reliable and repeatable fashion. While injection molding and compression molding are preferred processes, other conventional plastic molding processes are also contemplated for forming the Casket assembly 10.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A gasket assembly for use in connection with a valve assembly for an internal combustion engine, said gasket assembly including:

a carrier member having a peripheral edge portion that the serves as a gasket; and a plurality of valve stem seals integrally connected to said carrier member such that said gasket assembly is a single unit.

2. A gasket assembly as recited in claim 1, wherein said carrier member further includes a sealing member integral with said carrier member.

3. A gasket assembly as recited in claim 2, wherein said sealing member is a sealing bead disposed on an outer periphery of said carrier member.

4. A gasket assembly as recited in claim 2, wherein said sealing member is an elastomeric material molded to an outer periphery of said carrier member.

5. A gasket assembly as recited in claim 1, wherein said valve stem seals are connected to said carrier by at least two carrier arms, wherein a carrier end of each of said carrier arms is connected to an outer periphery of said carrier and a valve stem end is connected to one of said valve stem seals.

6. A gasket assembly as recited in claim 5, wherein said carrier arms further include at least one thinned portion that is deformable to permit selective removal of individual valve stem seals.

7. A gasket assembly as recited in claim 5, wherein said carrier arms further includes at least a first carrier arm and a second carrier arm, wherein said first carrier arm extends inwardly from a rear wall of said carrier and said second carrier arm extends inwardly from a front wall of said carrier.

8. A gasket assembly as recited in claim 7, wherein said first carrier arm extends downwardly at a first predetermined angle.

9. A gasket assembly as recited in claim 8, wherein said second carrier arm extends downwardly at a second predetermined angle.

10. A gasket assembly as recited in claim 1, further including at least one connector for connecting said valve stem seals together, wherein said connector is connected to two adjacent valve stem seals.

11. A gasket assembly as recited in claim 10, wherein said connector further include at least one thinned portion that is deformable to permit selective removal of an individual valve stem seal.

12. A gasket assembly as recited in claim 10, wherein said at least one connector is connected to a carrier arm, said carrier arm being integrally connected to said outer periphery of said carrier.

13. A gasket assembly as recited in claim 10, wherein said connector includes at least one handle portion is integrally formed thereon.

14. A gasket assembly as recited in claim 1, wherein said carrier includes at least one handle portion integrally formed thereon.

15. A gasket assembly for use in connection with a valve assembly for an internal combustion engine, said gasket assembly including:

a carrier member having an integral sealing member thereon;

a plurality of valve stem seals integrally connected to said carrier member by at least two integral carrier arms; and at plurality of connectors connecting said valve stem seals together, wherein at least one of said connectors is positioned between two adjacent valve stem seals to connect said valve stem seals together.

16. A gasket assembly as recited in claim 15, wherein at least one of said connectors includes a handle member integrally formed with said connector to facilitate handling of said gasket assembly.

17. A gasket assembly as recited in claim 15, wherein at least one of said carrier arms includes a handle member integrally formed with said carrier arm to facilitate handling of said gasket assembly.

18. A gasket assembly as recited in claim 15, wherein said carrier arms are integrally connected to said connectors to connect said valve stem seals to said carrier.

19. A gasket assembly as recited in claim 15, wherein said carrier arms further includes at least one thinned portion that is deformable to permit selective removal of individual valve stem seals.

20. A gasket assembly as recited in claim 15, wherein said connectors further includes at least one thinned portion that is deformable to permit selective removal of individual valve stem seals.

* * * * *

UNITED STATES PATENT AND TRADEMARK OFFICE

CERTIFICATE OF CORRECTION

PATENT NO. : 6,269,787 B1
DATED : August 7, 2001
INVENTOR(S) : Troy D. McArthy

It is certified that error appears in the above-identified patent and that said Letters Patent is hereby corrected as shown below:

Column 5,
Line 52, replace "portion that the" with -- portion that --.

Signed and Sealed this

Twenty-sixth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,269,787 B1
DATED : August 7, 2001
INVENTOR(S) : Troy D. McArthy

It is certified that error appears in the above-identified patent and that said Letters Patent is hereby corrected as shown below:

Title page,
Item [57], ABSTRACT,
Line 7, replace "or a web of valve steam seals. The" with -- or a web of valve stem seals. The --.

Signed and Sealed this

Thirteenth Day of May, 2003

JAMES E. ROGAN
*Director of the United States Patent and Trademark Office*